US010662566B2

(12) United States Patent
Choi et al.

(10) Patent No.: US 10,662,566 B2
(45) Date of Patent: May 26, 2020

(54) LAUNDRY TREATING APPARATUS

(71) Applicant: LG Electronics Inc., Seoul (KR)

(72) Inventors: Heechul Choi, Seoul (KR); Dongwoo Park, Seoul (KR); Juhan Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 191 days.

(21) Appl. No.: 15/740,948

(22) PCT Filed: Jun. 29, 2016

(86) PCT No.: PCT/KR2016/006944
§ 371 (c)(1),
(2) Date: Dec. 29, 2017

(87) PCT Pub. No.: WO2017/003171
PCT Pub. Date: Jan. 5, 2017

(65) Prior Publication Data

US 2018/0195225 A1 Jul. 12, 2018

(30) Foreign Application Priority Data

Jun. 30, 2015 (KR) ..... 10-2015-0092780

(51) Int. Cl.

| | |
|---|---|
| ***D06F 31/00*** | (2006.01) |
| ***D06F 29/00*** | (2006.01) |
| ***D06F 58/20*** | (2006.01) |
| *D06F 39/12* | (2006.01) |
| *D06F 37/24* | (2006.01) |
| *D06F 33/02* | (2006.01) |
| *D06F 39/00* | (2020.01) |
| *D06F 39/08* | (2006.01) |

(52) U.S. Cl.
CPC ..... *D06F 31/00* (2013.01); *D06F 29/005* (2013.01); *D06F 58/203* (2013.01); *D06F 33/02* (2013.01); *D06F 37/24* (2013.01); *D06F 39/005* (2013.01); *D06F 39/088* (2013.01); *D06F 39/12* (2013.01); *D06F 39/125* (2013.01); *D06F 2204/10* (2013.01)

(58) Field of Classification Search
CPC ..... D06F 31/00
See application file for complete search history.

(56) References Cited

U.S. PATENT DOCUMENTS

| | | | |
|---|---|---|---|
| 8,820,861 | B2 | 9/2014 | Kim et al. |
| 2002/0056293 | A1 | 5/2002 | Kin et al. |
| 2007/0151300 | A1 | 7/2007 | Sunshine |

(Continued)

FOREIGN PATENT DOCUMENTS

| | | |
|---|---|---|
| EP | 2703536 | 6/2005 |
| EP | 1548174 | 3/2014 |

OTHER PUBLICATIONS

European Search Report in European Appln. No. 16818204.6, dated Jan. 28, 2019, 10 pages.

(Continued)

*Primary Examiner* — Jason Y Ko
(74) *Attorney, Agent, or Firm* — Fish & Richardson P.C.

(57) ABSTRACT

A laundry treating apparatus is disclosed, which is provided with a first treating apparatus washing laundry, a second treating apparatus washing laundry, and a third treating apparatus drying laundry.

17 Claims, 9 Drawing Sheets

(56) References Cited

U.S. PATENT DOCUMENTS

| | | | | |
|---|---|---|---|---|
| 2010/0011609 | A1 | 1/2010 | Park et al. | |
| 2011/0041258 | A1 | 2/2011 | Ko et al. | |
| 2011/0252577 | A1 | 10/2011 | Kim et al. | |
| 2012/0234054 | A1 | 9/2012 | Kim et al. | |
| 2014/0075683 | A1* | 3/2014 | Kim | D06F 39/008 8/137 |
| 2014/0083142 | A1* | 3/2014 | Chung | D06F 33/02 68/12.06 |
| 2015/0135777 | A1* | 5/2015 | Cho | D06F 31/00 68/27 |

OTHER PUBLICATIONS

International Search Report and Written Opinion in International Application No. PCT/KR2016/006944, dated Oct. 18, 2016,13 pages.

* cited by examiner

[Fig. 1]
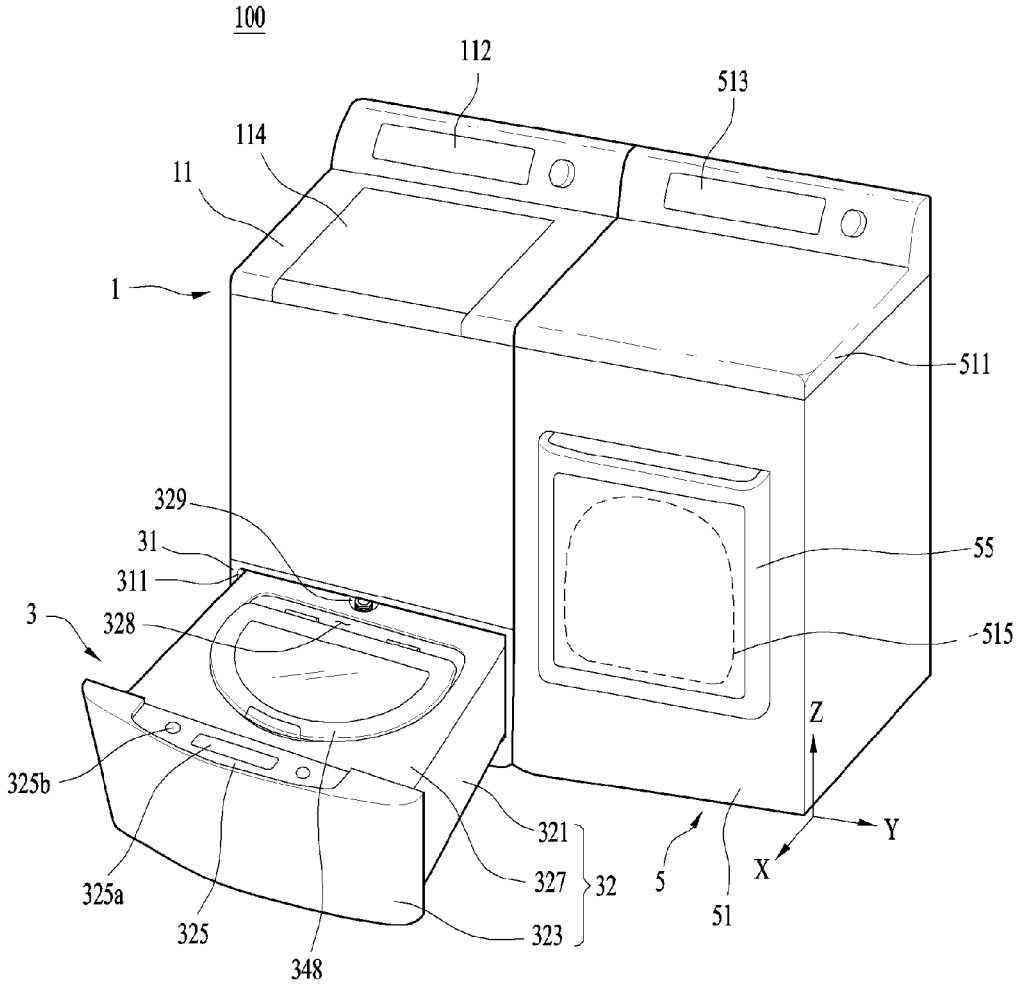

[Fig. 2]
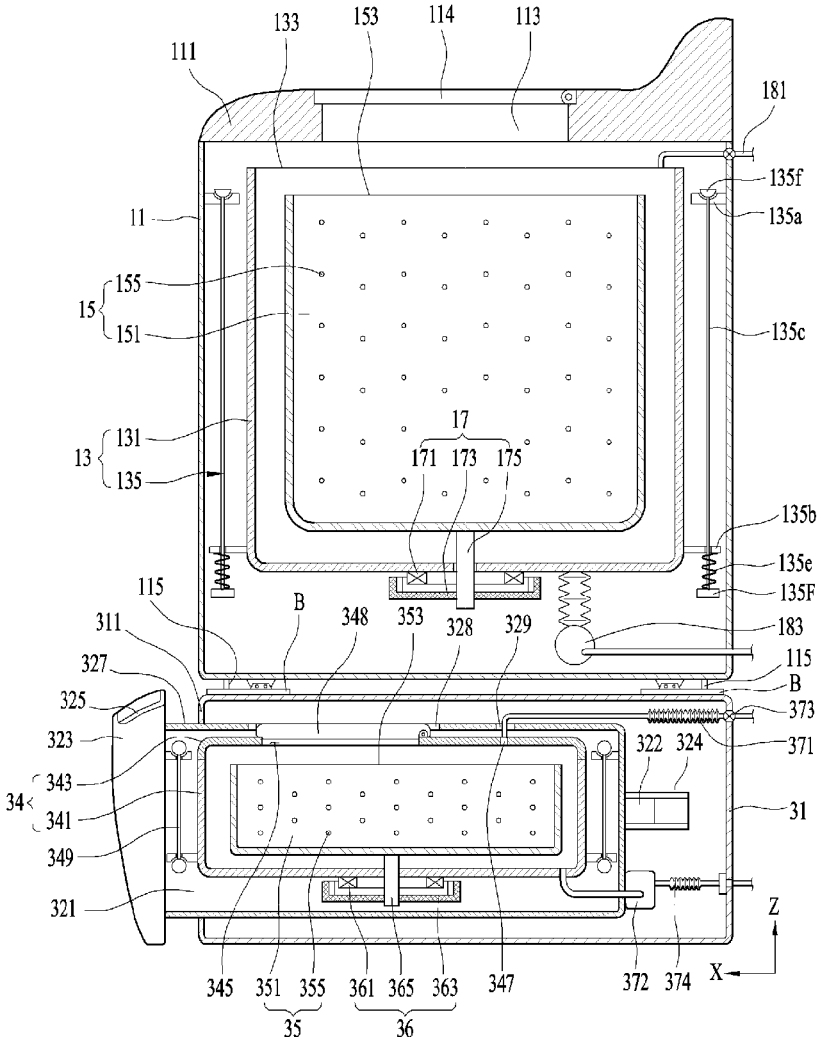

[Fig. 3]
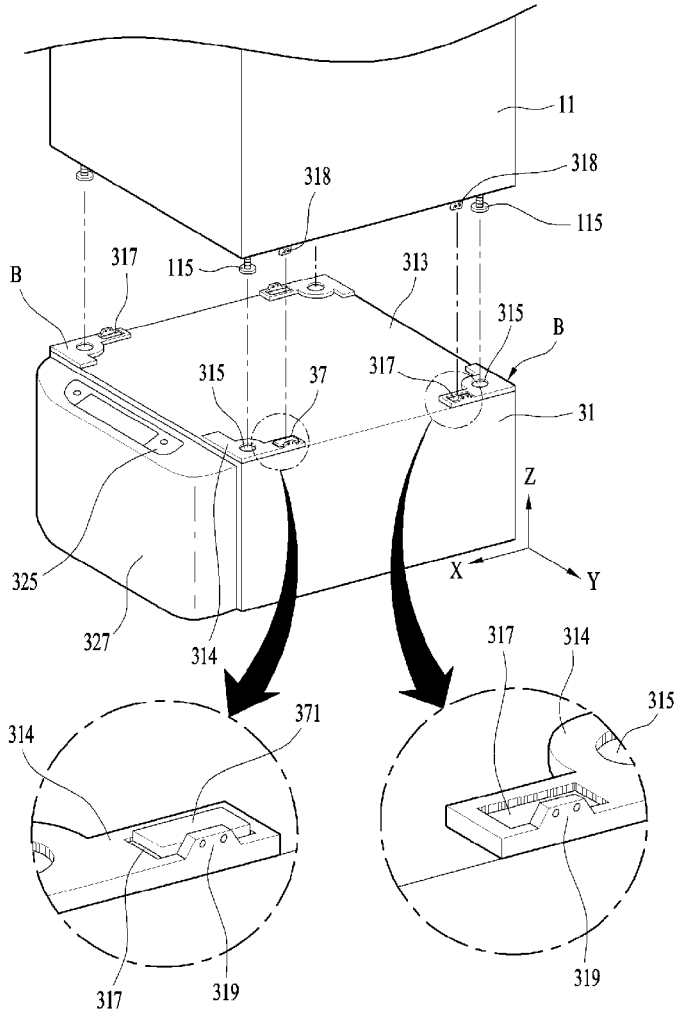

[Fig. 4]
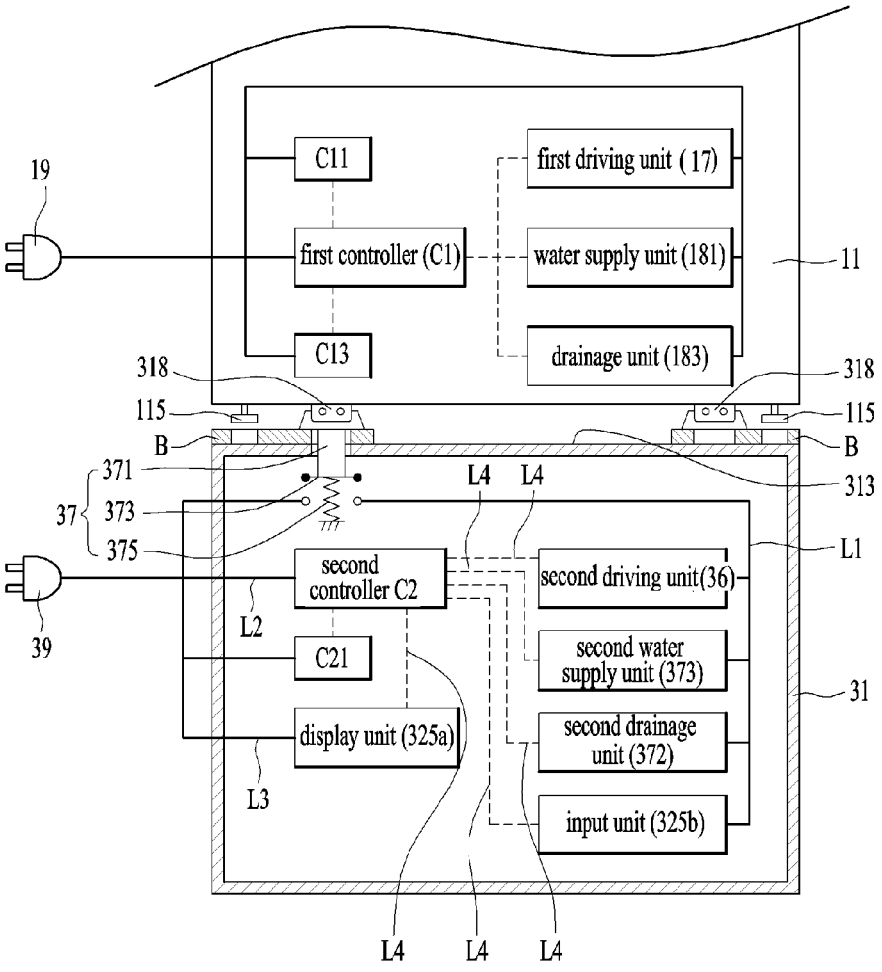

[Fig. 5]
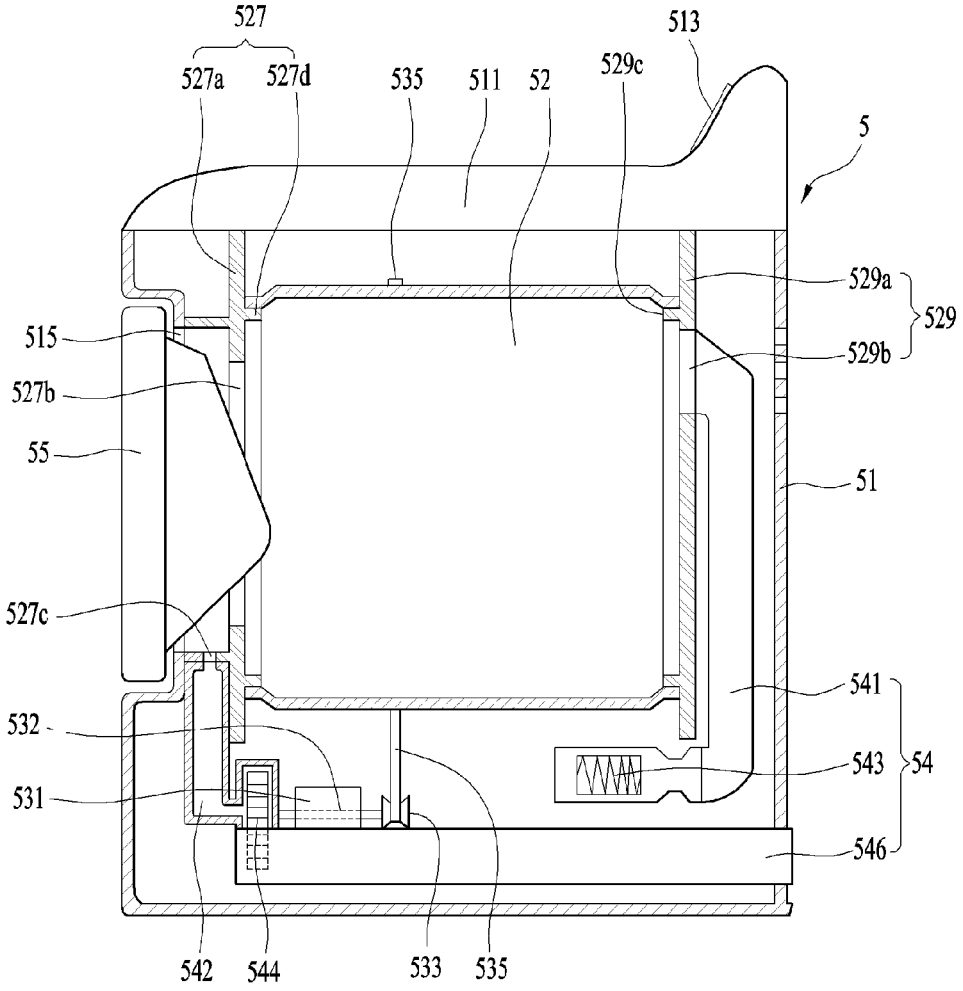

[Fig. 6]
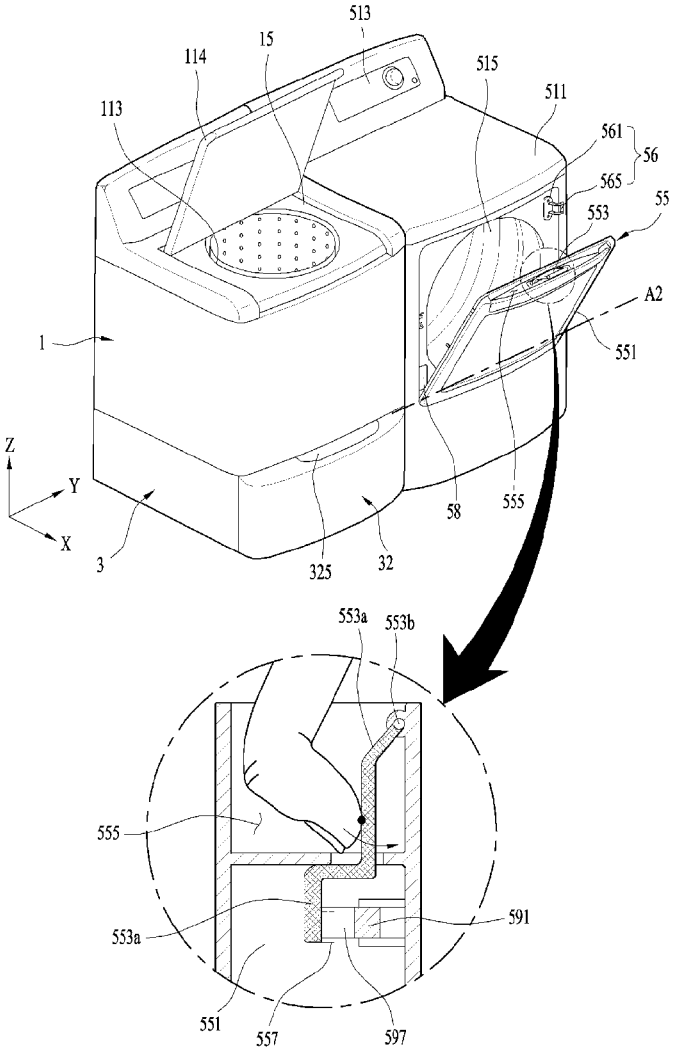

[Fig. 7]
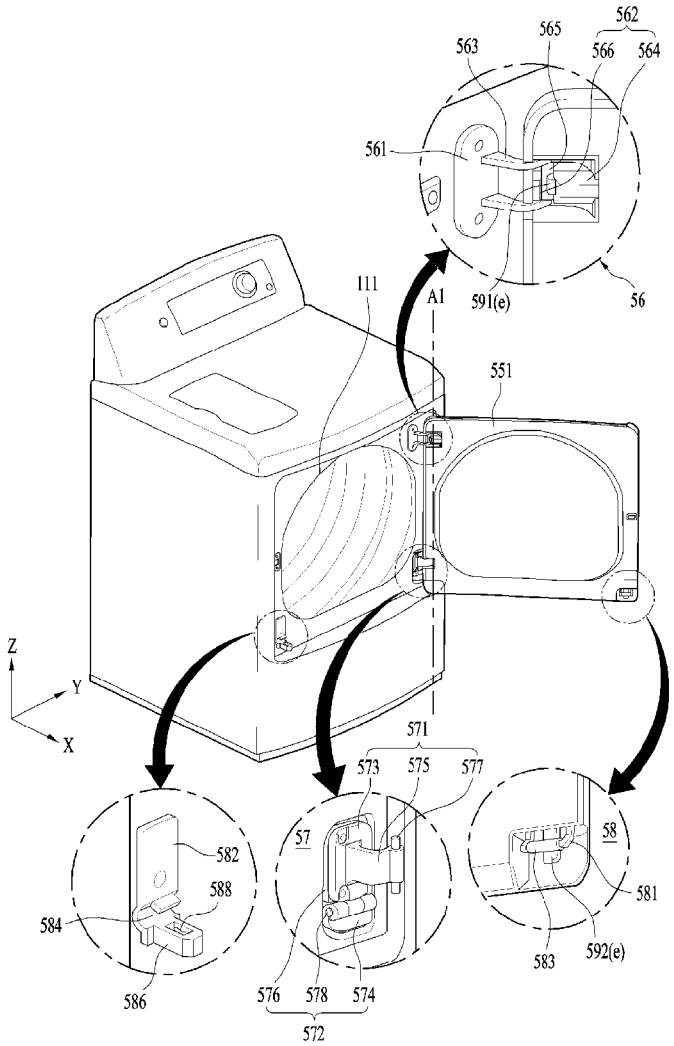

[Fig. 8]
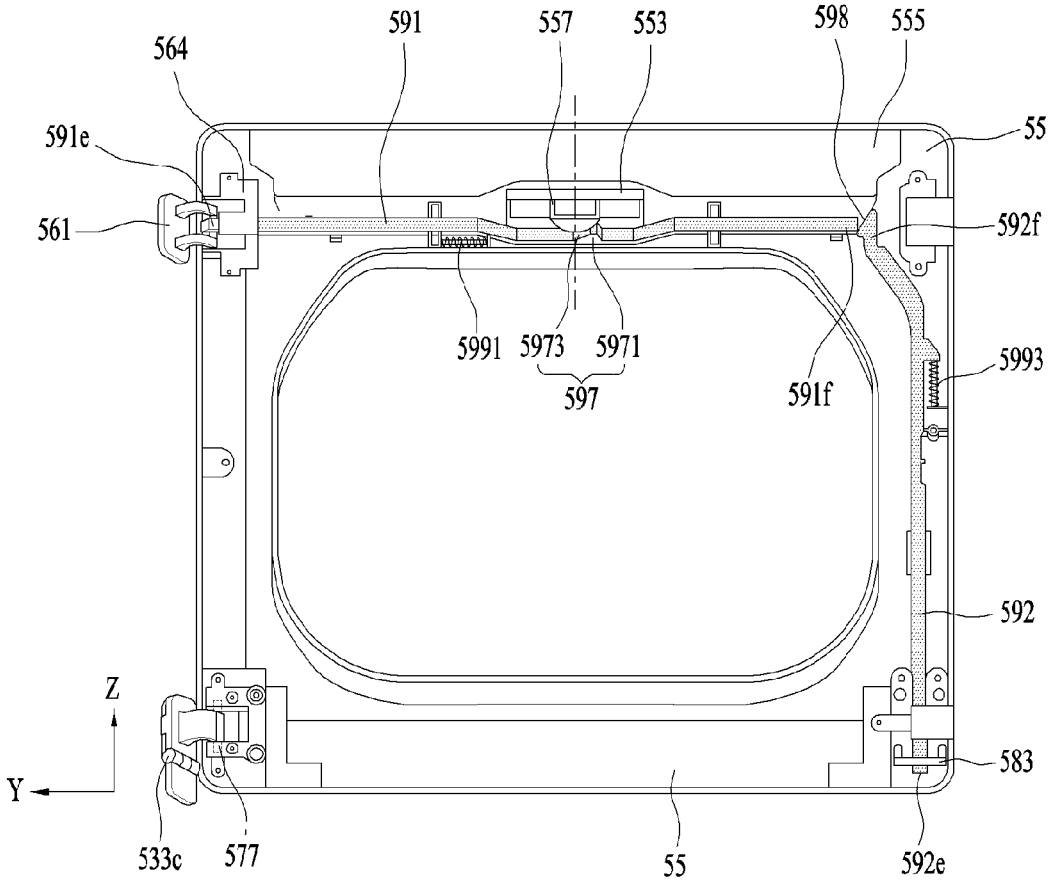

[Fig. 9]
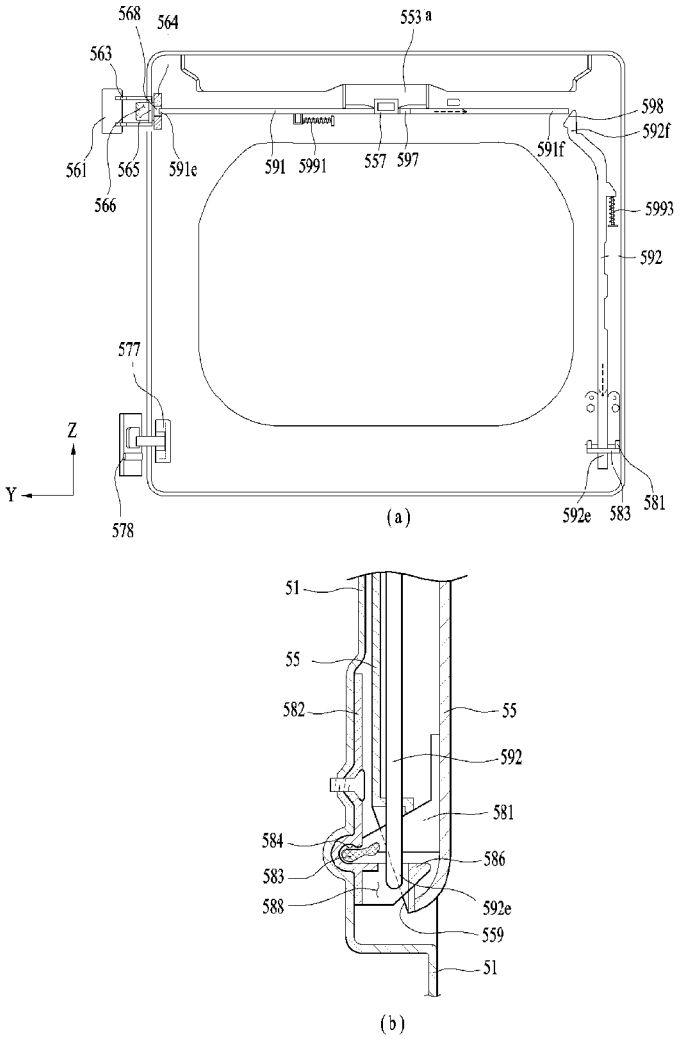

LAUNDRY TREATING APPARATUS

CROSS-REFERENCE TO RELATED APPLICATIONS

This application is the National Phase of PCT International Application No. PCT/KR2016/006944, filed on Jun. 29, 2016, which claims priority under 35 U.S.C. 119(a) to Korean Application No. 10-2015-0092780, filed on Jun. 30, 2015, which is hereby incorporated by reference herein in their entirety.

TECHNICAL FIELD

The present invention relates to a laundry treating apparatus.

BACKGROUND ART

Generally, a laundry treating apparatus includes an apparatus for washing laundry (laundry for washing or laundry for drying), an apparatus for drying laundry, and an apparatus for performing both washing and drying laundry.

A laundry treating apparatus of the related art has been categorized into a front loading type laundry treating apparatus having a laundry inlet provided in a front surface to load laundry therein and a top loading type laundry treating apparatus having a laundry inlet provided in a top side to load laundry therein.

Meanwhile, since the laundry treating apparatus of the related art should be designed to treat (wash, dry, etc.) laundry of a certain amount or more, there is limitation in reducing the volume of the laundry treating apparatus.

Due to the problem that it is difficult to reduce the volume of the laundry treating apparatus, a user who owns two laundry treating apparatuses should use the two treating apparatuses by arranging them on the ground in parallel. In this case, a problem occurs in that efficiency of a space where the laundry treating apparatus will be arranged may be reduced.

DISCLOSURE OF INVENTION

Technical Problem

The present invention is directed to a laundry treating apparatus that substantially obviates one or more problems due to limitations and disadvantages of the related art.

An object of the present invention is to provide a laundry treating apparatus in which a plurality of treating apparatuses provided with laundry treating functions (washing of laundry, drying of laundry, etc.) are stacked up or arranged in parallel to provide complex laundry treating functions.

Another object of the present invention is to provide a laundry treating apparatus in which laundry may easily move from one treating apparatus to another treating apparatus.

Still another object of the present invention is to provide a laundry treating apparatus in which laundry having a possible migration may be washed by sorting and clothes of which washing has been finished are dried at the same time.

Further still another object of the present invention is to provide a laundry treating apparatus that may minimize vibration occurring when two treating apparatuses stacked up are operated at the same time.

Further still another object of the present invention is to provide a laundry treating apparatus in which a lower treating apparatus arranged below an upper treating apparatus may be operated only if the upper treating apparatus is mounted thereon, to minimize vibration of the lower treating apparatus.

Further still another object of the present invention is to provide a laundry treating apparatus that may prevent an upper one of two treating apparatuses staked up from being dropped or overturned when the two treating apparatuses are operated.

Solution to Problem

To achieve these objects and other advantages and in accordance with the purpose of the invention, a laundry treating apparatus comprises a first treating apparatus washing laundry, a second treating apparatus washing laundry, and a third treating apparatus drying laundry, the first treating apparatus including a first cabinet provided with a first inlet on an upper surface; a first tub provided inside the first cabinet, storing water therein; and a first drum rotatably provided inside the first tub, receiving laundry supplied to the first inlet therein, the second treating apparatus including a second cabinet provided below the first cabinet, supporting the first cabinet; a drawer provided to be ejected from the second cabinet; a second tub provided inside the drawer, storing water therein and having a volume smaller than that of the first tub; a second inlet provided on an upper surface of the second tub; and a second drum rotatably provided inside the second tub, receiving laundry supplied to the second inlet therein, and the third treating apparatus including a third cabinet provided with a third inlet on a front surface, mounted at sides of the first cabinet and the second cabinet; a third drum provided inside the third cabinet, providing a space in which laundry supplied to the third inlet is received; and a drying unit drying the laundry by supplying the air to the third drum.

The third inlet may be provided at a position lower than the first inlet and higher than the second inlet.

The first treating apparatus may further include a first drum rotational shaft connected to the first drum by passing through the first tub and orthogonal to the bottom of the first tub, and the second treating apparatus may further include a second drum rotational shaft connected to the second drum by passing through the second tub and orthogonal to the bottom of the second tub.

The first drum rotational shaft and the second drum rotational shaft may be arranged on one straight line.

The first drum rotational shaft may be controlled to have a rotational direction different from that of the second drum rotational shaft when the first drum rotational shaft and the second drum rotational shaft are rotated at the same time.

The first treating apparatus may further include a vibration sensor sensing a size of vibration, and the second treating apparatus may further include a controller terminating an operation of the second treating apparatus, temporarily the operation of the second treating apparatus or lowering the number of rotation of the second drum when the vibration measured by the vibration sensor is a predetermined reference value or more.

The second treating apparatus may further include a second treating apparatus driving unit for rotating the second drum; a second treating apparatus controller for controlling the second treating apparatus driving unit; and a connector for allowing the second treating apparatus controller to control the operation of the second treating apparatus driving unit only if the first treating apparatus is mounted on the second treating apparatus.

The connector may open or close a circuit, which supplies a power to the second treating apparatus driving unit, depending on whether the first cabinet has been arranged on the second cabinet.

The laundry treating apparatus may further comprise a first connector provided on the bottom of the first cabinet; and a second connector provided on an upper surface of the second cabinet and detachably coupled to the first connector, and the connector may include a pressurizer provided to pass through the upper surface of the second cabinet and pressurized by the first connector and a switching unit opening or closing a circuit, which supplies a power to the second treating apparatus driving unit, depending on a position of the pressurizer.

The connector may open or close a control circuit, which connects the second treating apparatus controller with the second treating apparatus driving unit, depending on whether the first cabinet has been arranged on the second cabinet.

The laundry treating apparatus may further comprise a third treating apparatus door opening or closing the third inlet; a first rotational shaft coupling the third treating apparatus door with the third cabinet and rotating the third treating apparatus door along a first direction; and a second rotational shaft coupling the third treating apparatus door with the third cabinet and rotating the third treating apparatus door along a second direction set to be different from the first direction.

The first rotational shaft may be provided along a direction orthogonal to the bottom of the third cabinet, and the second rotational shaft may be arranged below the third inlet and provided along a direction parallel with the bottom of the third cabinet.

The laundry treating apparatus may further comprise an angle controller for controlling a rotational angle of the third treating apparatus door when the third treating apparatus door is rotated around the second rotational shaft.

The angle controller may be provided to maintain the third treating apparatus door as a state rotated as much as a predetermined reference angle at the third inlet.

The reference angle may be set to an angle that may move laundry mounted in the third treating apparatus door to the third inlet by means of self-load.

Advantageous Effects of Invention

According to the present invention, a laundry treating apparatus may be provided, in which a plurality of treating apparatuses provided with laundry treating functions are stacked up or arranged in parallel to provide complex laundry treating functions.

Also, according to the present invention, a laundry treating apparatus may be provided, in which laundry may easily move from one treating apparatus to another treating apparatus.

Also, according to the present invention, a laundry treating apparatus may be provided, in which laundry having a possible migration may be washed by sorting and clothes of which washing has been finished are dried at the same time.

Also, according to the present invention, a laundry treating apparatus may be provided, which may minimize vibration occurring when two treating apparatuses stacked up are operated at the same time.

Also, according to the present invention, a laundry treating apparatus may be provided, in which a lower treating apparatus arranged below an upper treating apparatus may be operated only if the upper treating apparatus is mounted thereon, to minimize vibration of the lower treating apparatus.

Also, according to the present invention, a laundry treating apparatus may be provided, in which an upper one of two treating apparatuses staked up may be prevented from being dropped or overturned when the two treating apparatuses are operated.

BRIEF DESCRIPTION OF DRAWINGS

FIGS. 1 and 2 illustrate examples of a laundry treating apparatus according to the present invention.

FIG. 3 illustrates an example of a coupling structure of first and second laundry treating apparatuses provided in the present invention.

FIG. 4 illustrates an example of a connector provided in a second treating apparatus.

FIGS. 5 and 6 illustrate examples of a third treating apparatuses provided in the present invention.

FIG. 7 illustrates an example of a third treating apparatus door and a hinge unit.

FIGS. 8 and 9 illustrate examples of a rotational shaft switching unit provided in a third treating apparatus door.

BEST MODE FOR CARRYING OUT THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

As shown in FIG. 1, a laundry treating apparatus 100 according to the present invention may include a first treating apparatus 1 for washing laundry, a second treating apparatus 3 arranged below the first treating apparatus to wash laundry, and a third treating apparatus 5 arranged at sides of the first and second treating apparatuses 1 and 3 to dry laundry.

As shown in FIG. 2, the first treating apparatus 1 may include a first cabinet 11 constituting appearance, a first tub 13 provided inside the first cabinet 11, storing washing water therein, a first drum 15 provided inside the first tub 13, receiving laundry therein, and a first driving unit 17 rotating the first drum 15.

The first cabinet 11 may include a first cabinet cover 111 constituting an upper portion of the first treating apparatus 1. The first cabinet cover 111 may include a first inlet 113 supplying laundry to the first drum 15 or taking out laundry stored in the first drum 15, and a first control panel 112 controlling an operation of the first treating apparatus 1. The first inlet 113 is opened or closed by a first treating apparatus door 114 (first door) rotatably provided in the first cabinet 11.

A height controller 115 may be provided on the bottom of the first cabinet 11. The height controller 115 is a means for supporting the first cabinet 11 on the upper surface 313 of the second treating apparatus 3, and a user may control or level a height of the first cabinet 11 through the height controller 115.

The first tub 13 may be provided in all shapes that may store washing water therein, and is supplied with washing water through a first water supply unit 181 and discharges washing water to the outside of the first cabinet 11 through a first drainage unit 183.

The first tub 13 includes a first tub body 131 of a cylindrical shape, and a first tub inlet 133 provided in the first tub body 131 and communicated with the first inlet 113. The first tub body 131 may be fixed into the first cabinet 11 through a first tub support unit 135. It is preferable that the first tub support unit 135 is provided in a structure that may absorb vibration generated in the first tub 13.

The first tub inlet 133 may be provided in all shapes that may load laundry supplied from the first inlet 113 into the first tub body. In an example of FIG. 2, the first tub inlet 133 is provided on an opened upper surface of the first tub body 131.

The first tub support unit 135 may include a cabinet bracket provided in the first cabinet 11, a tub bracket 135*b* provided in the first tub body 131, and a rod 135*c* having one end connected to the cabinet bracket and the other end connected to the tub bracket.

The rod 135*c* may be coupled to the cabinet bracket 135*a* through a loader 135*f*, and may be connected to the tub bracket 135*b* through a supporter 135*d* and a spring 135*e*. The loader 135*f* is provided in a sphere shape or semi-sphere shape and mounted on the cabinet bracket 135*a*, and the spring 135*e* may be provided as a compressed spring arranged between the supporter 135*d* and the tub bracket 135*b*.

The first drum 15 may include a first drum body 151 arranged inside the first tub 13, receiving laundry therein. Since the first drum body 151 is rotated inside the first tub body 131 by the first driving unit 17, it is preferable that the first drum body 151 is provided in a cylindrical shape.

The first drum body 151 may be provided with a first drum inlet 143 communicated with the first tub inlet 133 and the first tub inlet 113, and its circumference may be provided with a through hole 155 that allows washing water supplied to the first tub body 131 to flow into the first drum body 151.

The first drum inlet 153 may be provided in all shapes that may communicate the first tub inlet 133 with the inside of the first drum body 151. In the example of FIG. 2, the first drum inlet 153 is exemplarily provided as an opened surface arranged on the first drum body 151.

The aforementioned first drum 15 is rotated inside the first tub 13 by the first driving unit 17. The first driving unit 17 may include a stator 171 fixed to an external bottom of the first tub 13, forming a rotating magnetic field, a rotor 173 rotated by the rotating magnetic field, and a first drum rotational shaft 175 provided to pass through the bottom of the first tub 13, connecting the rotor 173 with the first drum body 151.

If the first treating apparatus 1 is provided in a top loading type in which the first inlet 113 is arranged in the cover 111 (upper surface of the first cabinet), it is preferable that the first drum rotational shaft 175 is provided to be orthogonal to the bottom of the cabinet.

In the first treating apparatus 1 having the aforementioned structure, a first controller C1 (first treating apparatus controller) washes laundry by rotating the first drum 15 through the first driving unit 17 after supplying washing water to the first tub 13 through the first water supply unit 181. Afterwards, the first controller C1 discharges out washing water to the outside of the first tub through the first drainage unit 183 and then dehydrates laundry by rotating the first drum 15 through the first driving unit 17.

Each of the elements 17, 181, 183, 112, etc. provided in the first treating apparatus including the first controller C1 is supplied with a power through a first power line 19 (first treating apparatus power line, see FIG. 4).

As shown in FIGS. 1 and 2, the second treating apparatus 3 may include a second cabinet 31 arranged below the first treating apparatus 1, a drawer 32 able to be ejected from the second cabinet 31, a second tub 34 arranged inside the drawer 32, storing washing water therein, and a second drum 35 provided inside the second tub 34, storing laundry therein.

A front through hole 311 is provided on a front surface of the second cabinet 31, and the drawer 32 may be ejected from or inserted into the second cabinet 31 through the front through hole 311.

The drawer 32 includes a drawer body 321 of which upper surface is opened, and a drawer cover 327 provided in an opened surface of the drawer body 321, forming an upper surface of the drawer body 321.

As shown in FIG. 2, the drawer body 321 is detachably coupled to the second cabinet 31 through a rail 322 and a rail support unit 324, wherein the rail support unit 324 may be provided to be fixed to the second cabinet, and the rail 322 may be fixed to the drawer body 321 so as to be ejected from the rail support unit 324.

A drawer panel 323 is provided on a front surface of the drawer body 321, and may serve as a means for opening or closing the front through hole 311 and at the same time a handle for ejecting or inserting the drawer body 321 from or into the second cabinet 31.

The drawer panel 323 may be provided with a second control panel 325 for controlling an operation of the second treating apparatus 3. The second control panel 325 is provided with a means (second treating apparatus controller) for controlling a second water supply unit, a second drainage unit, and a second driving unit, which will be described later.

As shown in FIG. 1, the second control panel 325 may be provided with an input unit 325*b* for allowing a user to input a control command to the second treating apparatus 3 and a display unit 325*a* for notifying a user of acknowledgement of the control command input through the input unit 325*b* or a process of implementing the control command input by the user.

The drawer cover 327 is provided with first and second through holes 328 and 329, which are provided to pass through the drawer cover 327 and communicate the inside of the drawer body 321 with the outside of the drawer body 321. Functions of the first and second through holes 328 and 329 will be described later.

As shown in FIG. 2, the second tub 34 may include a second tub body 341 fixed into the drawer 32 by a second tub support unit 349, and a tub cover 343 forming an upper surface of the second tub body 341.

If the first treating apparatus 1 and the second treating apparatus 3 are provided to wash laundry, the volume of the second tub 34 may be set to be the same as that of the first tub 13 but may preferably be set to be smaller than that of the first tub 13.

If the first treating apparatus 1 is mounted on the upper surface of the second treating apparatus 3, a diameter of the first tub will be almost the same as that of the second tub. In this condition, if the first treating apparatus 1 and the second treating apparatus 3 are provided such that the volume of the first tub is the same as that of the second tub, a height of the first inlet 113 provided in the first treating apparatus 1 becomes too high, whereby a user may have a difficulty in loading or ejecting laundry into or from the first drum 15.

Therefore, if the first treating apparatus 1 is mounted on the upper surface of the second treating apparatus 3, the volume of the second tub 34 is preferably provided to be smaller than that of the first tub 13. If the diameter of the first tub is the same as or similar to that of the second tub, the height of the second tub is preferably provided to be smaller than that of the first tub.

The tub cover 343 is provided with a second tub inlet 345 (second inlet) provided to communicate the inside of the second tub body 341 with the outside thereof, wherein the second inlet 345 is opened or closed by a second treating apparatus door 348 (second door).

Since the second inlet 345 is arranged below the first through hole 328, the second drawer 348 may be rotated with respect to the outside of the drawer 32 through the first through hole 328 provided in the drawer cover 25. Therefore, the user may load laundry into the second tub 34 by ejecting the drawer 32 from the second cabinet 31 and then opening the second door 348.

Meanwhile, a supply inlet 347 connected with a water supply pipe 371 is further provided on the upper surface of the second tub 34. The water supply pipe 371 is a means for connecting a water supply source with the supply inlet 347, and is inserted into the drawer through the second through hole 329 provided in the drawer cover.

The second drum 35 may include a second drum body 351 of a cylindrical shape, a second drum inlet 353 provided on an upper surface of the second drum body 351, and a plurality of through holes 355 provided to pass through the second drum body 351.

Since the second drum inlet 353 is arranged below the second inlet 345, the second drum inlet 353 serves as a passage through which laundry is supplied to the second drum body 351, and the through holes 355 serve as passages through which washing water inside the second tub 34 flows into the second drum body 351.

The second drum body 351 may be rotated by the second driving unit 36. The second driving unit 36 may include a stator 361 fixed to the second tub 34, forming a rotating magnetic field, a rotor 363 rotated by the rotating magnetic field, and a second drum rotational shaft 365 connecting the bottom of the second drum body 351 with the rotor 363 by passing through the second tub 34. As shown, the second drum rotational shaft 365 may be provided to be orthogonal to the bottom of the drawer 32.

The second tub 34 is supplied with washing water through the second water supply unit, and discharges out the washing water through the second drainage unit, wherein the second water supply unit may include a water supply pipe 371 for connecting a water supply source (not shown) with the supply inlet 347, and a water supply valve 373 for opening or closing the water supply pipe 371 through the second controller C2 (controller of the second treating apparatus, see FIG. 4).

The second drainage unit may include a drainage pipe 374 guiding washing water inside the second tub 34 to the outside of the second cabinet 31, and a drainage pump 372 for discharging out the washing water inside the second tub 34 in accordance with a control signal of the second treating apparatus controller.

Meanwhile, since the drawer 32 provided in the second treating apparatus 3 should be provided to be ejected from the second cabinet 31, it is preferable that the water supply pipe 371 and the drainage pipe 374 are provided in a retractile structure or are made of an elastic material.

If the first drum 15 is rotated to dry laundry, vibration may occur in the first cabinet 11. The greater the vibration occurring in the first cabinet 11 becomes, the greater the risk of the first treating apparatus 1 to be dropped from the second treating apparatus 3 becomes. To avoid this risk, it is preferable that the first treating apparatus 1 and the second treating apparatus 3 are coupled to each other through a cabinet fastening unit B.

The cabinet fastening unit B is a means for coupling the first treating apparatus 1 to the second treating apparatus 3, and if the first treating apparatus 1 is coupled to the second treating apparatus 3 by the cabinet fastening unit B, the risk of the first treating apparatus to be dropped from the second treating apparatus 3 is minimized.

Also, since the first treating apparatus 1 mounted on the second cabinet 31 will serve to absorb or reduce vibration occurring in the second treating apparatus 3, vibration of the second treating apparatus 3 may be minimized through the cabinet fastening unit B in the present invention.

Meanwhile, if the drawer 32 is ejected from the second cabinet 31 in a state that the first treating apparatus is not mounted on the second treating apparatus, the center of gravity of the second treating apparatus 3 moves to the front of the second cabinet 31, whereby the rear of the second treating apparatus 3 may be detached from the ground. Therefore, the cabinet fastening unit B serves as a means for solving the problem that the rear of the second treating apparatus 3 is detached from the ground when the drawer 31 is ejected from the second cabinet 32.

As shown in FIG. 3, the cabinet fastening unit B may include a first connector 318 provided in the first cabinet 11, a fastening body 314 fixed to an upper surface 313 of the second cabinet, and a second connector 319 provided in the fastening body 314 and coupled to the first connector 318.

Meanwhile, if a height controller 115 is provided on the bottom of the first treating apparatus, the cabinet fastening unit B may further include a controller receptacle 315 for receiving the height controller 115 therein.

The controller receptacle 315 may be provided as a groove obtained as the surface of the fastening body 314 is recessed, or may be provided as a hole that passes through the fastening body 314.

Since the aforementioned advantages intended through the cabinet fastening unit B cannot be achieved if the user detaches the first treating apparatus 1 from the second treating apparatus 3, the laundry treating apparatus 100 of the present invention may further include a connector 37 for allowing the second treating apparatus 3 to be operated only if the first treating apparatus 1 is arranged on the second treating apparatus 3.

As shown in FIG. 4, the connector 37 may be provided to open or close open a first circuit L1 that supplies a power to the respective elements 361, 373, 372, 325*b*, etc., which require power supply, among the elements provided in the second treating apparatus.

The first circuit L1 may be connected with a power source through a second power line 39 (second treating apparatus power line), and may be provided as a circuit that supplies a power to the elements 361, 373, 372, 325*b*, etc. except the second controller C2 and the display unit 325*a* among the elements provided in the second treating apparatus, requiring a power supply. In this case, the second controller C2 may be provided to be always supplied with a power through a second circuit L2, and the display unit 325*a* may be provided to be always supplied with a power through a third circuit L3.

As one example, the connector 37 of FIG. 4 closes the first circuit L1 if the first treating apparatus 1 is mounted on the upper surface 313 of the second treating apparatus 3, and opens the first circuit L1 if the first treating apparatus 1 is detached from the upper surface 313 of the second treating apparatus 3.

The connector 37 may include a pressurizer 317 provided to pass through the upper surface 313 of the second cabinet and pressurized by the first connector 318, a switching unit 373 provided in the pressurizer 317, opening or closing the first circuit L1, and an elastic support unit 375 pressurizing the switching unit 373 in a direction far away from the first circuit L1.

If the pressurizer 371 is provided to be pressurized by the first connector 318 provided on the bottom of the first treating apparatus without being pressurized by a separate device provided in the first treating apparatus, the cabinet fastening unit B may further include a pressurizer receptacle 317 where the pressurizer 371 is arranged, as shown in FIG. 3. That is, the pressurizer receptacle 317 may be provided to pass through the fastening body 314.

Two or more of the aforementioned connector 37 may be provided in the second treating apparatus 3, or one connector 37 may be provided in the second treating apparatus 3 as shown in FIG. 3.

Meanwhile, unlike FIG. 4, the connector 37 may be provided to open or close the second power line 39, or may be provided to open or close a control circuit L4 that connects the second controller C2 with the elements 361, 373, 372, 325*b*, etc.

In the case that the first treating apparatus 1 is arranged on the upper surface of the second treating apparatus 3, the aforementioned advantages may be obtained, whereas disadvantages may be caused as follows.

Since the first treating apparatus is provided with the first drum 15 rotated by the first drum rotational shaft 175 and the second treating apparatus is provided with the second drum 35 rotated by the second drum rotational shaft 365, if the first drum 15 and the second drum 35 are rotated in the same direction, the first treating apparatus 1 and the second treating apparatus 3, which are coupled to each other, may be fallen down.

Meanwhile, even though the first drum 15 has a rotational direction different from that of the second drum 35, if the center of rotation of the first drum 15 is different from that of the second drum 35, vibration occurring in the first treating apparatus 1 and the second treating apparatus 3 may be amplified during rotation of each drum.

To solve the aforementioned problems, it is preferable that the center of rotation of the first drum 15 and the center of rotation of the second drum 35 are arranged on the same straight line, and it is also preferable that at least one of the first controller C1 and the second controller C2 prevents the rotational directions of the two drums 15 and 35 from being the same as each other.

To match the centers of rotation of the two drums with each other, the first drum rotational shaft 175 and the second drum rotational shaft 365 are arranged on one straight line orthogonal to the ground (or arranged on a vertical line).

Meanwhile, to prevent the rotational directions of the two drums 15 and 35 from being the same as each other, the first controller C1 and the second controller C2 should be able to perform communication with each other. FIG. 4 illustrates an example that the controllers C1 and C2 perform communication with each other through a first communication unit C11 provided in the first treating apparatus 1 and a second communication unit C21 provided in the second treating apparatus.

In this case, since any one of the first controller C1 and the second controller C2 may acknowledge the rotational direction of the drum, which is transmitted from the other controller, the corresponding controller may prevent the two drums 15 and 35 from being rotated in the same direction when the two drums are rotated at the same time.

Even though the centers of rotation of the respective drums may be prevented from being matched with each other or the rotational directions of the drums may be prevented from being the same as each other, if the size of vibration occurring in any one of the treating apparatuses 1 and 3 already exceeds a certain level, it is preferable to interrupt rotation of at least one of the two drums 15 and 35.

For example, if the two drums continue to be rotated in a state that the size of vibration occurring in the first treating apparatus 1 exceeds a predetermined reference value, vibration of the first treating apparatus 1 is increased by vibration occurring in the second treating apparatus 3, whereby there may be the risk of the first treating apparatus and the second treating apparatus which may be overturned together.

To solve the problem, the first treating apparatus 1 may further include a vibration sensor C13 for measuring vibration occurring in the first treating apparatus 1, and the second controller C2 may be provided to temporarily interrupt the operation of the second treating apparatus if the size of vibration measured by the vibration sensor C13 is the reference value or more (for example, the second controller C2 may be provided to temporarily interrupt rotation of the second drum while maintaining the power supplied to the second treating apparatus). The second controller C2 may acknowledge the size of vibration sensed by the vibration sensor C13 through the first communication unit C11 and the second communication unit C21.

Meanwhile, if the size of vibration measured by the vibration sensor C13 is the reference value or more, the second treating apparatus controller C2 may be provided to terminate the operation of the second treating apparatus (interrupt the power supplied to the second treating apparatus).

Also, if the size of vibration measured by the vibration sensor C13 is the reference value or more, the second treating apparatus controller C2 may be provided to change a course currently performed by the second treating apparatus to another course. Change of the course of the second treating apparatus means that a control command currently performed by the second treating apparatus is changed to another control command to minimize vibration of the second treating apparatus. As an example, the second treating apparatus controller may change the number of rotation of the second drum to the lower number of rotation.

The third treating apparatus 5 arranged at the sides of the first treating apparatus and the third treating apparatus 3 is to dry laundry of which washing has been finished. The laundry treating apparatus 100 of the present invention is characterized in that laundry having a passible migration is washed respectively by the first treating apparatus 1 and the second treating apparatus and laundry of which washing has been finished may be dried by the third treating apparatus 5.

The migration means that a dye existing in laundry moves to another laundry during washing. Since this migration barely occurs during drying of laundry unlike washing, even though the laundry washed respectively by the first and second treating apparatuses is dried by one apparatus 5 at the same time, the migration will not occur.

As shown in FIG. 5, the third treating apparatus 5 includes a third cabinet 51 arranged at sides of the first cabinet 11 and the second cabinet 31, a third drum 52 provided inside the third cabinet, storing laundry therein, and a drying unit 54 supplying the air to the third drum 52.

The third cabinet 51 is provided with a front panel 517 that forms a front surface of the third treating apparatus, and a third inlet 515 provided in the front panel, serving as a passage through which laundry is loaded into the third drum 52.

Meanwhile, the third cabinet 51 may further include a third cabinet cover 511 that forms the upper surface of the third treating apparatus, and the third cabinet cover 511 may further include a third control panel 513 for controlling the operation of the third treating apparatus. The third control panel 513 may include a means (controller of the third treating apparatus) for controlling the drying unit 54 and the third driving unit 53, which will be described later.

As shown in FIG. 6, it is preferable that the third inlet 515 is arranged between the first inlet 113 and the second inlet 345 to facilitate movement of laundry ejected from the first inlet 113 to the third inlet 515 and movement of laundry ejected from the second inlet 345 to the third inlet 515. That is, it is preferable that the third inlet 515 is provided to be lower than the first inlet 113 and higher than the second inlet 345.

Meanwhile, if a value obtained by adding the height of the first treating apparatus 1 and the height of the second treating apparatus 3 to each other becomes higher than the height of the second treating apparatus 3, a problem may occur in that it is difficult for the user to load or eject laundry into or from the first drum 15 through the first inlet 113.

Therefore, the value obtained by adding the height of the first treating apparatus 1 and the height of the second treating apparatus 3 to each other may be the same as or lower than the height of the third treating apparatus 5 (a value obtained by adding the height of the first cabinet and the height of the second cabinet to each other may be the same as or lower than the height of the third cabinet).

Moreover, a distance from the bottom of the second treating apparatus 3 to the first inlet 113 may be the same as or shorter than a distance from the bottom of the third treating apparatus 5 to the third cabinet cover 511. The third cabinet cover 511 is provided with the third control panel 513, and the third control panel 513 should be provided at a position that may easily be touched by the user's hand. Therefore, if the height of the first inlet 113 is set to be lower than the position of the third cabinet cover 511 provided with the third control panel 513, a problem that may occur due to the height of the first inlet 113 may be minimized.

For design uniformity of the laundry treating apparatus in which the first treating apparatus 1, the second treating apparatus 3 and the third treating apparatus 5 are assembled with one another, appearance of the third cabinet cover 511 may be provided in the same shape as appearance of the first cabinet cover 111.

As shown in FIG. 5, the third drum 52 may be provided as a drum body that provides a space for receiving laundry therein. If both surfaces where the drum body faces are provided in an opened cylindrical shape, the opened surface arranged at the front of the drum body may be supported by a front support unit 527, and the opened surface arranged at the rear of the drum body may be supported by a rear support unit 529.

The front support unit 527 may include a first support body 527*a* fixed into the third cabinet, a body through hole 527*b* provided to pass through the first support body 527*a*, communicating the third inlet 515 with the third drum 52, and a front flange 527*d* provided on the circumference of the body through hole 527*b*, rotatably supporting the opened front surface of the third drum 52.

The rear support unit 529 may include a second support body 529*a* fixed into the third cabinet, and a rear flange 529*c* provided in the second support body, rotatably supporting the rear surface of the third drum 52.

The drying unit 54 may include air discharge units 542, 544 and 546 discharging out the air of the third drum through the front support unit 527, and air supply units 541 and 543 supplying the air to the third drum through the rear support unit 529.

In this case, the front support unit 527 should further include a discharge hole 527*c* for discharging the air inside the third drum 52 to the air discharge unit, and the rear support unit 529 should further include an inlet hole 529*b* for allowing the air discharged from the air supply unit to flow into the third drum 52.

The air supply unit may include a supply duct 541 connected with the inlet hole 529*b*, and a heat exchanger 543 heating the air flown to the supply duct 541.

The air discharge unit may include a connection duct 542 connected to the discharge hole 527*c*, a discharge duct 546 guiding the air, which is flown to the connection duct 542, to the outside of the third cabinet 51, and a fan 544 provided in any one of the connection duct and the discharge duct, moving the air inside the third drum 52 to the connection duct 542.

Meanwhile, unlike the aforementioned description, the drying unit 54 may be provided to dehumidify and heat the air discharged from the third drum 52 and then resupply the air to the third drum 52. In this case, the discharge duct 542 should be connected to the supply duct 541 (free end of the supply duct should be connected with the discharge duct), and the heat exchanger 543 may be provided to include a dehumidifying unit for removing moisture included in the air by cooling the air inside the discharge duct, and a heating unit for heating the air that has passed through the dehumidifying unit.

The third drum 52 and the fan 544 may be rotated by the third driving unit 53. That is, the third driving unit 53 may include a motor 531, a motor shaft 532 rotated by the motor, a pulley 533 fixed to the first free end of the motor shaft, and a belt 535 connecting a circumference of the pulley with the circumference of the third drum. In this case, the fan 544 may be connected to the second free end of the motor shaft.

The third inlet 515 provided on the front surface of the third cabinet is opened or closed by the third treating apparatus door 55 (third door), and the third door 55 is rotatably coupled to the third cabinet 51 through two different rotational shafts A1 and A2 formed by hinge units 56, 57 and 58 (see FIGS. 6 and 7).

As shown in FIG. 6, the third door 55 may include a door body 551 that opens or closes the third inlet 515, and a handle 553 provided in the door body 551, controlling a rotational shaft switching unit 59, which will be described later. The handle 553 may be provided in a receiving groove 555 obtained as an upper surface of the door body 551 is recessed.

The handle 553 may be provided with a handle body 553*a* provided in the receiving groove 555, a body rotational shaft 553*b* rotatably connecting the handle body 553*a* with the door body 551, and a switching unit pressurizer 558 for operating the rotational shaft switching unit 59, which will be described later, depending on rotation of the handle body 553*a*. The rotational shaft switching unit 59 is a means provided inside the door body 551 to enable a user to switch the door rotational shafts A1 and A2, and its detailed description will be described later.

As shown in FIG. 7, the hinge units 56, 57 and 58, which couple the door body 551 to the third cabinet 51, may be provided with a first hinge 56 having a first shaft 565, a third hinge 58 having a fourth shaft 583, and a second hinge 57 having a second shaft 577 forming the first rotational shaft A1 together with the first shaft 565 and a third shaft 578 forming the second rotational shaft A2 together with the fourth shaft 583.

The first hinge 56 may be provided with a first hinge body 561 provided in any one of the third cabinet 51 and the door body 551, to which the first shaft 565 is fixed, and a first shaft detachable unit 562 provided in the other one of the front panel 517 and the door body 551, to which the first shaft 565 is detachably coupled.

The first hinge body 561 is provided with a first shaft support unit 563 that supports the first shaft 565.

The first shaft detachable unit 562 includes a housing 564 provided in the door body 551, and a first shaft receptacle 566 provided in the housing 564, providing a space where the first shaft 565 is received. The housing 564 is provided with a housing through hole 568 (see FIG. 9) provided to pass through the housing 564 along a width direction Y of the door body 551, and a function of the housing through hole 568 will be described later.

The second hinge 57 may be provided with a door support unit 571 having the second shaft 577, and a cabinet fastening unit 572 rotatably fixing the door support unit 571 to the front panel 517.

The cabinet fastening unit 572 may be provided with a fastening unit body 574 fixed to the front panel 517 and a rotary valve 576 rotatably coupled to the fastening unit body 574 through the third shaft 578.

In this case, the door support unit 571 may be provided with a support body 573 fixed to the rotary valve 576 and a second shaft support 575 provided to be protruded from the support body 573, supporting the second shaft 577.

The door body 511 is rotatably coupled to the second shaft 577, and the second shaft 577 is provided in parallel with the first shaft 565 of the first hinge 56, whereby the first rotational shaft A1 is formed by the first shaft 565 and the second shaft 577.

The third hinge 58 may be provided with the fourth shaft 583 provided in any one of the door body 551 and the front panel 517, and a fourth shaft detachable unit 582 provided in the other one of the door body 551 and the front panel 517, to which the fourth shaft 583 is detachably coupled.

FIG. 7 illustrates an example that the fourth shaft 582 is provided in the door body 551 and the fourth shaft detachable unit 582 is provided in the front panel 517. The fourth shaft 583 is supported by a third hinge body 581 fixed to the door body 551.

The fourth shaft detachable unit 582 may be provided with a fourth shaft receptacle 584 providing a space where the fourth shaft 583 is received, and switching unit receptacles 586 and 588 provided to be protruded from the fourth shaft detachable unit 582.

Since the fourth shaft receptacle 584 is provided in parallel with the third shaft 578, the fourth shaft 583 inserted into the fourth shaft receptacle 584 forms the second rotational shaft A2 together with the third shaft 578.

The switching unit receptacles may be provided as a protrusion 586 protruded from the fourth shaft detachable unit 582 and a protrusion through hole 588 provided to pass through the protrusion 586. The switching unit receptacles 586 and 588 are spaces where a second switching unit 592 of the rotational shaft switching unit 59, which will be described later, is coupled, and their detailed description will be made later.

As shown in FIG. 8, rotational shaft switching units 591 and 592, which allow a user to select the rotational shafts A1 and A2 of the third treating apparatus door, are provided in the door body 551.

The rotational shaft switching units may be provided as the first switching unit 591 performing a reciprocating motion by means of the handle 553 along a width direction Y of the door body 551 and the second switching unit 592 performing a reciprocating motion by means of the first switching unit 591 along a height direction Z of the door body 551.

The first switching unit 591 may be provided as a bar provided along the width direction Y of the door body 551, and its first free end 591*e* is provided to open or close the first shaft receptacle 566 by passing through the housing 564 and its second free end 591*f* is provided to contact the second switching unit 592.

The first switching unit 591 is provided with a contact unit 597 which is in contact with the switching unit pressurizer 557 of the handle, wherein the contact unit 597 may be provided with a contact body 5971 provided to be protruded from the first switching unit and an inclined surface 5973 provided in the contact body 5971.

Therefore, as shown in FIG. 9, if the user pressurizes the handle body 553*a*, the inclined surface 5973 will move toward a second free end 592*f* of the second switching unit by means of the switching unit pressurizer 557, whereby the first free end 591*e* of the first switching unit will open the first shaft receptacle 566 such that the first shaft 565 may be ejected from the first shaft receptacle 566.

The second switching unit 592 may be provided as a bar provided along the height direction Z of the door body 551, and includes a first free end 592*e* (third free end) inserted into the protrusion through hole 588 provided in the switching unit receptacle and a second free end 592*f* (fourth free end) of the second switching unit, which is in contact with the second free end 591*f* of the first switching unit.

In order that an external force input to the first switching unit 591 through the handle 553 is easily delivered to the second switching unit 592, a switching unit inclined surface 598 may further be provided in any one of the second free end 591*f* of the first switching unit and the second free end 592*f* of the second switching unit.

Meanwhile, if the third treating apparatus door 55 closes the third inlet 515, the rotational shaft switching unit 59 may further be provided with an elastic support unit that pressurizes the first switching unit 591 toward the first shaft detachable unit 562 to maintain the state that the third treating apparatus door 55 is coupled to the first rotational shaft A1.

The elastic support unit may be provided to include any one of a first switching unit support 5991 pressurizing the first free end 591*e* of the first switching unit toward the first shaft detachable unit 562 and a second switching unit support 5993 pressurizing the first free end 592*e* of the second switching unit to be far away from the switching unit receptacles 586 and 588.

In the state of FIG. 8, the third treating apparatus door 55 is able to be rotated through the first rotational shaft A1 orthogonal to the ground (the state of FIG. 7). In the state of FIG. 9, the third treating apparatus door 55 is able to be rotated through the second rotational shaft A2 parallel with the ground (the state of FIG. 6).

Meanwhile, when the third treating apparatus door 55 is rotated around the second rotational shaft A2, the third treating apparatus 5 may further be provided with an angle controller that controls a rotational angle of the third treating apparatus door 55.

The angle controller is a means for maintaining the state of the third treating apparatus door 55 rotated as much as a predetermined reference angle at the third inlet 515, wherein the reference angle may be set to 0° to 90°.

If the reference angle is set to 90°, the third treating apparatus door 55 may perform a function of a rack that supports laundry discharged from the first treating apparatus or the second treating apparatus.

Meanwhile, as shown in FIG. 6, if the reference angle is set to an angle (for example, 30° to 60°) which is greater than 0° and smaller than 90°, the third treating apparatus door 55 may perform a function of a guider that guides the laundry to the third inlet 515 (laundry mounted in the third treating apparatus door will move to the third inlet by means of self-load).

In this case, the angle controller may be provided as an inclined surface 559 (see FIG. 9(*b*)) that is arranged below the door body 551 and is in contact with the front panel 517 when the third treating apparatus door 55 is rotated around the second rotational shaft A2, to restrict a rotational angle of the third treating apparatus door.

Moreover, the third treating apparatus door 55 may open the third inlet 515 at two different angles. In this case, the first angle may be set to 30° to 60° while the second angle may be set to 90°.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

The invention claimed is:

1. A laundry treating apparatus comprising:

a first washing apparatus configured to wash laundry, the first washing apparatus including:

a first cabinet that has a first inlet on an upper surface of the first cabinet, a first tub that is located inside of the first cabinet, that is configured to receive water therein, and that is configured to receive a first volume of water, and a first drum that is located within the first tub, that is configured to receive laundry supplied through the first inlet, and that is configured to rotate within the first tub;

a second washing apparatus configured to wash laundry, the second washing apparatus including:

a second cabinet located below the first cabinet and configured to support the first cabinet, a drawer that is located in the second cabinet and that is configured to be drawn into and out of the second cabinet, a second tub that is located inside of the drawer, that is configured to receive water therein, and that is configured to receive a second volume of water, the second volume of water being smaller than the first volume of water, a second inlet located on an upper surface of the second tub, and a second drum that is located within the second tub, that is configured to receive laundry supplied through the second inlet, and that is configured to rotate within the second tub; and a drying apparatus configured to dry laundry, the drying apparatus including:

a third cabinet that has a third inlet on a front surface of the third cabinet, the third cabinet being configured to be disposed at a side of the first and second cabinet, a third drum that is located inside of the third cabinet and that is configured to receive laundry supplied through the third inlet, and a drying unit configured to dry laundry received in the third drum by supplying air to the third drum, wherein a height of the drying apparatus is equal to a sum of heights of the first washing apparatus and the second washing apparatus.

2. The laundry treating apparatus according to claim 1, wherein the third inlet is located at a position lower than the first inlet and higher than the second inlet.

3. The laundry treating apparatus according to claim 1, wherein the first washing apparatus includes a first rotational shaft that is connected to the first drum, that passes through the first tub, and that is oriented orthogonal to a bottom of the first tub, and the second washing apparatus includes a second rotational shaft that is connected to the second drum, that passes through the second tub, and that is oriented orthogonal to a bottom of the second tub.

4. The laundry treating apparatus according to claim 3, wherein the first rotational shaft and the second rotational shaft are arranged in a straight line.

5. The laundry treating apparatus according to claim 3, further comprising a controller that is configured to control the first rotational shaft to have a first rotational direction different from a second rotational direction of the second rotational shaft based on the first rotational shaft and the second rotational shaft being rotated at the same time.

6. The laundry treating apparatus according to claim 1, wherein the first washing apparatus includes a vibration sensor configured to sense a size of vibration of the first washing apparatus, and the second washing apparatus includes a controller configured to (1) terminate an operation of the second washing apparatus, (2) temporarily stop the operation of the second washing apparatus, or (3) lower a number of rotations per minute of the second drum based on the size of vibration sensed by the vibration sensor being a predetermined reference value or more.

7. The laundry treating apparatus according to claim 1, wherein the second washing apparatus includes:

a second driving unit configured to rotate the second drum;

a second controller configured to control the second driving unit; and a connector configured to allow the second controller to control operation of the second driving unit based on the first washing apparatus being mounted on the second washing apparatus.

8. The laundry treating apparatus according to claim 7, wherein the connector is configured to open or close a circuit, which supplies power to the second driving unit, depending on whether the first cabinet is arranged on the second cabinet.

9. The laundry treating apparatus according to claim 8, further comprising:

a first connector located on a bottom of the first cabinet; and a second connector located on an upper surface of the second cabinet and detachably coupled to the first connector, and wherein the connector includes a pressurizer that passes through the upper surface of the second cabinet and is configured to be pressurized by the first connector and a switching unit configured to open or close a circuit, which supplies power to the second driving unit, depending on a position of the pressurizer.

10. The laundry treating apparatus according to claim 7, wherein the connector is configured to open or close a control circuit, which connects the second controller with the second driving unit, depending on whether the first cabinet is arranged on the second cabinet.

11. The laundry treating apparatus according to claim 1, further comprising:

a third door configured to open or close the third inlet;

a first rotational shaft configured to couple the third door to the third cabinet and configured to rotate the third door in a first direction; and a second rotational shaft configured to couple the third door to the third cabinet and configured to rotate the third door in a second direction that is different from the first direction.

12. The laundry treating apparatus according to claim 11, wherein the first rotational shaft is oriented in a direction orthogonal to a bottom of the third cabinet, and the second rotational shaft is arranged below the third inlet and oriented in a direction parallel to the bottom of the third cabinet.

13. The laundry treating apparatus according to claim 11, further comprising an angle controller configured to control a rotational angle of the third door based on the third door being rotated around the second rotational shaft.

14. The laundry treating apparatus according to claim 13, wherein the angle controller is configured to maintain the third door in a rotational state that is rotated at least a predetermined reference angle relative to the third inlet.

15. The laundry treating apparatus according to claim 13, wherein the angle controller is configured to maintain the third door in a rotational state that is rotated as much as a predetermined reference angle.

16. The laundry treating apparatus according to claim 1, wherein the upper surface of the first cabinet and an upper surface of the third cabinet are configured to define a single plane based on the third cabinet being disposed at the side of the first and second cabinets.

17. The laundry treating apparatus according to claim 1, wherein the height of the drying apparatus is a vertical distance from a bottom surface of the third cabinet to an upper surface of the third cabinet, and wherein the sum of the heights of the first washing apparatus and the second washing apparatus is a vertical distance from a bottom surface of the second cabinet to the upper surface of the first cabinet.

* * * * *